US008235372B2

(12) United States Patent
Boucher

(10) Patent No.: US 8,235,372 B2
(45) Date of Patent: Aug. 7, 2012

(54) WEB GUIDING APPARATUS

(75) Inventor: Ronald Henry Boucher, Goffstown, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 12/806,020

(22) Filed: Aug. 4, 2010

(65) Prior Publication Data

US 2012/0035039 A1 Feb. 9, 2012

(51) Int. Cl.
*B41L 43/04* (2006.01)

(52) U.S. Cl. ..... 270/52.07; 270/5.01; 270/41

(58) Field of Classification Search ..... 270/5.01, 270/12, 16, 40, 41, 43, 44, 52.07, 52.08; 242/615.1, 615.2, 615.21; 101/219, 228, 101/231, 480

See application file for complete search history.

(56) References Cited

U.S. PATENT DOCUMENTS

| | | | | |
|---|---|---|---|---|
| 5,016,801 | A * | 5/1991 | Gilat et al. | 242/615.21 |
| 5,357,859 | A * | 10/1994 | Eckert | 101/228 |
| 5,520,317 | A * | 5/1996 | Eckert et al. | 242/615.12 |
| 6,047,922 | A * | 4/2000 | Michalik | 242/615.21 |
| 7,523,925 | B2 * | 4/2009 | Herbert et al. | 270/5.02 |
| 2010/0201065 | A1 * | 8/2010 | Dawley et al. | 271/278 |

* cited by examiner

*Primary Examiner* — Leslie A Nicholson, III

(74) *Attorney, Agent, or Firm* — Davidson, Davidson & Kappel, LLC

(57) ABSTRACT

A web guiding apparatus is provided. The web guiding apparatus includes an angle bar and an angle bar support supporting the angle bar. The angle bar support has a first end portion and a second end portion. The web guiding apparatus also includes a first actuator coupled to the angle bar support for moving the first end portion along a vertical axis and a second actuator coupled to the angle bar support for moving the second end portion along a horizontal axis. A folder for a printing press is also provided.

15 Claims, 9 Drawing Sheets

WEB GUIDING APPARATUS

The present invention relates to generally to printing presses and more particularly to web guiding apparatuses used in web printing presses.

BACKGROUND OF THE INVENTION

In web offset printing presses, printing units may print text and images on a web substrate. A folder may fold the printed web and cut the printed web into a plurality of signatures. The folder may include one or more angle bars that guide and reorient the web for folding and cutting. The angle bars may each be provided internally with air by an air source and direct the air towards the passing web through holes formed in an outer surface of each angle bar. The air may eliminate friction between the angle bars and the web to improve transport of the web through a printing press and to prevent the web guiding device from marking the web.

In printing presses where the web is reoriented from traveling in a horizontal orientation (parallel to the ground) to a vertical orientation (traveling on one side, perpendicular to the ground) a relatively long length of the web is acted on by several lead rolls and a ninety degree angle bar to reorient the web. Examples of such arrangements are disclosed in commonly owned U.S. patent application Ser. Nos. 12/322,738, 12/322,767, 12/322,768 and 12/322,775. The use of the relatively long length of traveling web may contribute to difficulties in control, formation of wrinkles in the web and errors in the lateral position as the reoriented web travels away from the angle bar. Also, the use of ninety degree angle bars in multiple web configurations may sometimes lead to web congestion. Web guides may also sometimes be used to control web position.

SUMMARY OF THE INVENTION

A web guiding apparatus is provided. The web guiding apparatus includes an angle bar, and an angle bar support supporting the angle bar. The angle bar support has a first end portion and a second end portion. The web guiding apparatus also includes a first actuator coupled to the angle bar support for moving the first end portion along a first axis and a second actuator coupled to the angle bar support for moving the second end portion along a second axis different from the first axis.

A web guiding apparatus is also provided that includes a first support, a second support, a first angle bar for guiding a first web movably coupled to the first support and the second support and a second angle bar for guiding a second web movably coupled to the first support and the second support.

BRIEF DESCRIPTION OF THE DRAWINGS

The present invention is described below by reference to the following drawings, in which.

DETAILED DESCRIPTION OF THE PREFERRED EMBODIMENTS

Figure 1:
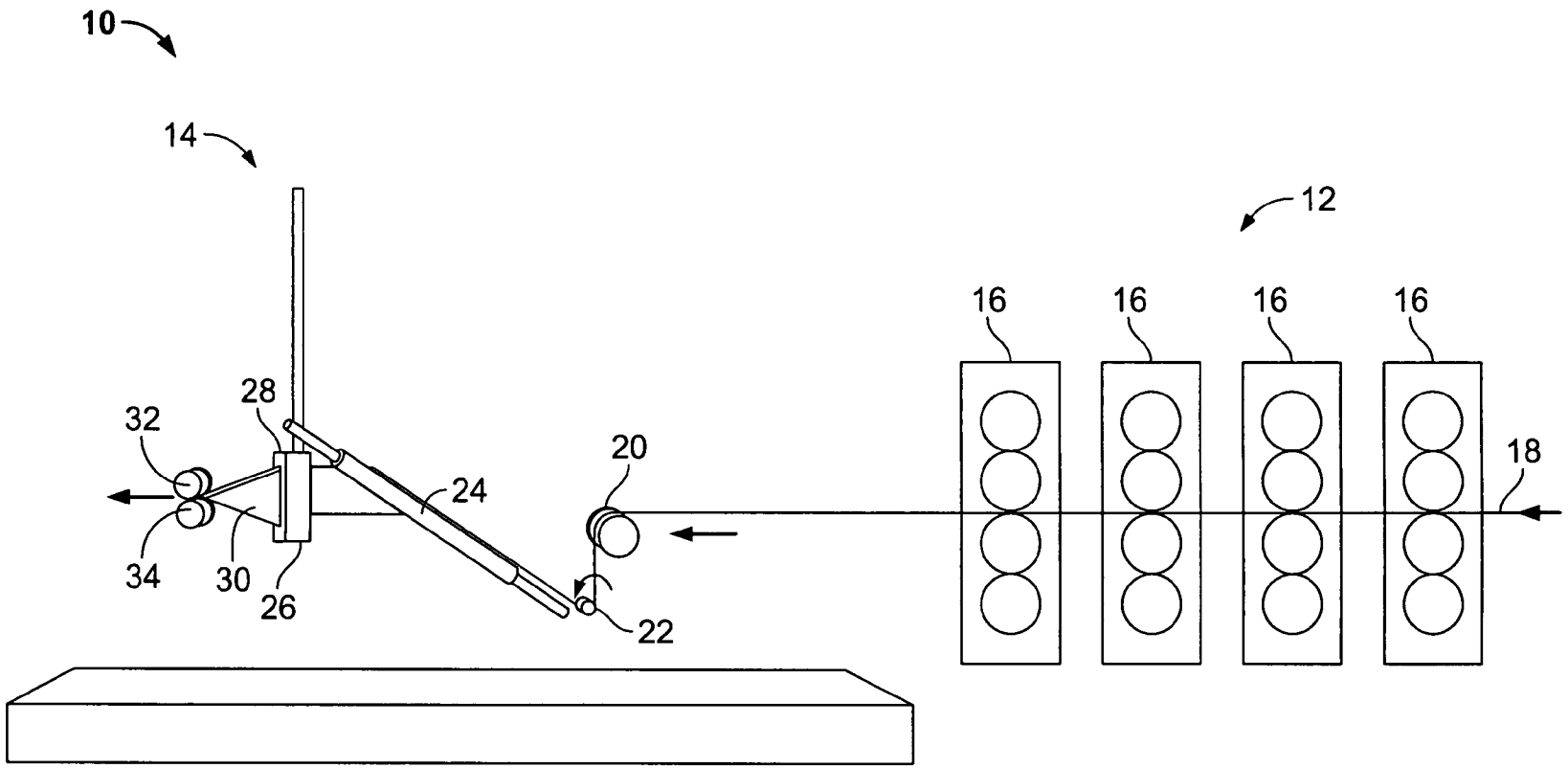
FIG. 1 schematically shows a side view of a web printing press according to an embodiment of the present invention.

FIG. 1 schematically shows a side view of a web printing press 10 according to an embodiment of the present invention. Printing press 10 includes a printing section 12 and a folder 14. Printing section 12, which includes a plurality of printing units 16, prints on a traveling web 18. As web 18 enters folder 14, web 18 is guided by a horizontally aligned pull roll 20 and a horizontally aligned compensator roll 22 to an angle bar 24, which reorients web 18 from a horizontal orientation (traveling on a width of web 18) to a vertical orientation (traveling on one side of web 18). After being reoriented by angle bar 24, web 18 passes through a nip formed by vertically aligned gather rolls 26, 28 and is drawn across a former 30 by a pair of horizontally aligned pull rolls 32, 34 to longitudinally fold web 18.

Figure 2:
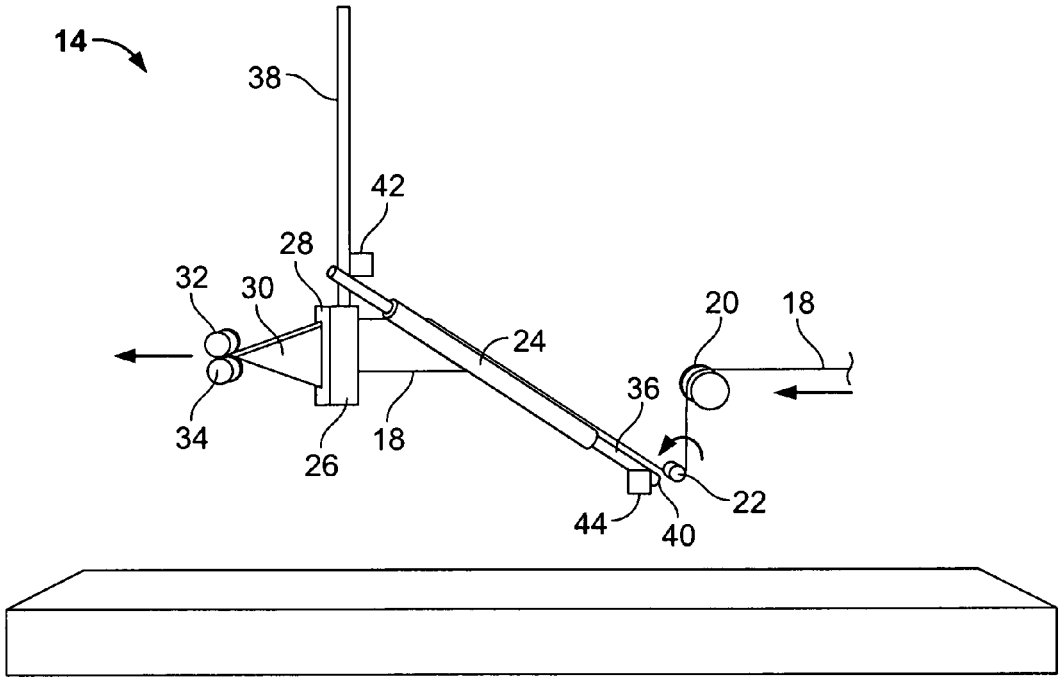
FIGS. 2 to 4 schematically show a side view, a top view and a perspective view, respectively, of a folder of the web printing press shown in FIG. 1.
Figure 3:
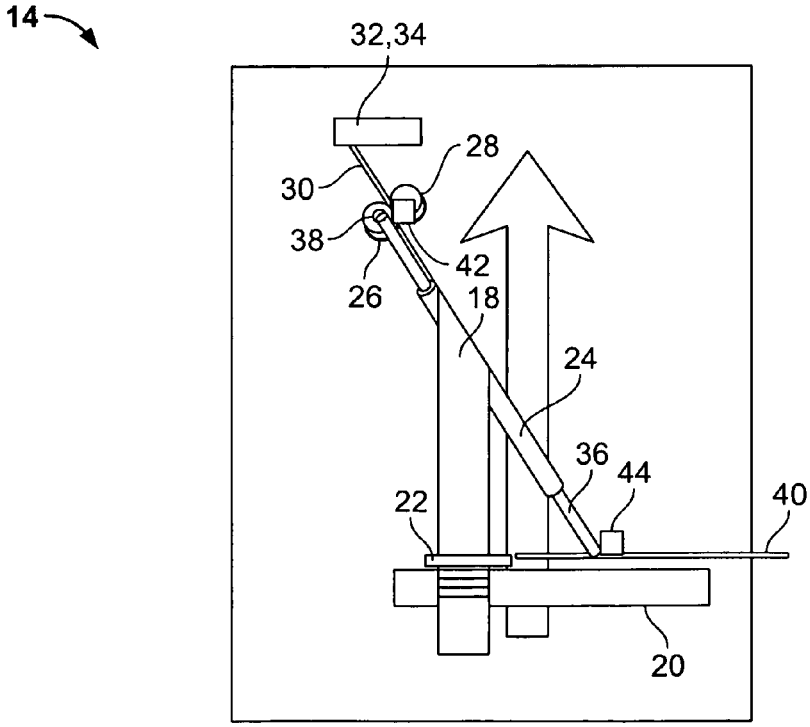
Figure 4:
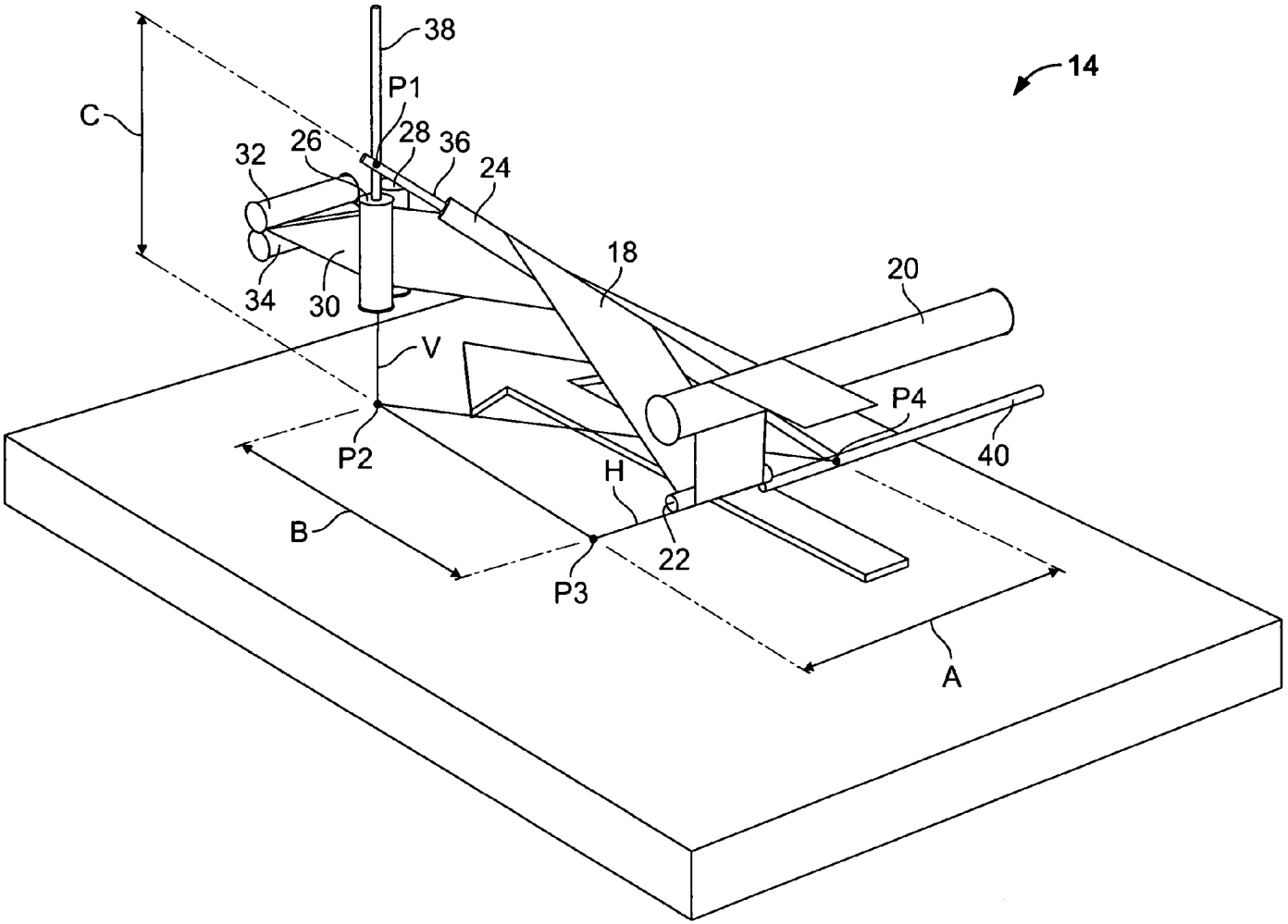

FIGS. 2 to 4 schematically show a side view, a top view and a perspective view, respectively, of folder 14 guiding web 18. Pull roll 20, compensator roll 22, angle bar 24, gather rolls 26, 28 and pull rolls 32, 34 guide web 18 for longitudinal folding by horizontally aligned former 30. Angle bar 24 is coupled to an angle bar support 36 which allows angle bar 24 to be adjusted in two different dimensions. Near an upper end portion of angle bar support 36, angle bar support 36 is movably coupled to a vertical support 38 and near a lower end portion of angle bar support 36, angle bar support 36 is movably coupled to a horizontal support 40. An actuator 42 coupled to the upper end portion of angle bar support 36 may move angle bar support 36 up and down on support 38 and an actuator 44 coupled to the lower end portion of angle bar support 36 may move angle bar support 36 side-to-side on support 40. Actuators 42, 44 are omitted from FIG. 4 for clarity. As a result, angle bar support 36 is vertically movable along vertical support 38 and horizontally movable along horizontal support 40. During operation of folder 14, the position of angle bar support 36 is secured in place with respect to both vertical support 38 and horizontal support 40. In an alternative embodiment, angle bar 24 may be fixedly coupled to vertical support 38 and horizontal support 40 and vertical support 38 may be movable vertically and horizontal support 40 may be moved horizontally to alter the orientation of angle bar 24.

Because a length of angle bar support 36 between vertical support 38 and horizontal support 40 varies with the movement of angle bar support 36 along vertical support 38 and horizontal support 40, at least one end of angle bar support 36 may extend past either or both of vertical support 38 and horizontal support 40. For example, a lower end of angle bar support 36 may be slidably received in horizontal support 40, but an upper end of angle bar support 36 may extend past vertical support 38. In this case, a mechanism that couples angle bar support 36 and vertical support 38 together is axially slidable with respect to both angle bar support 36 and vertical support 38. In another exemplary embodiment, at least one end of angle bar support 36 may be telescopically movable and neither of the ends of angle bar support 36 extends past vertical support 38 or horizontal support 36.

FIG. 4 shows the spacing between important points of folder 14. A point P1 illustrates a position of angle bar support 36 along vertical support 38 and a point P4 illustrates a position of angle bar support 36 along horizontal support 40. A point P2 illustrates where a plane of horizontal support 40 parallel to the ground intersects an axis V of vertical support 38 and a point P3 illustrates where a plane of vertical support 38 perpendicular to the ground intersects an axis H of horizontal support 40. In a preferred embodiment, a distance C between point P1 and point P2 always equals a distance A between point P3 and point P4 and distance B between point P2 and point P3 is greater than zero. As a result, if angle bar support 36 is moved vertically by actuator 42 (FIGS. 2 and 3), angle bar support 36 is moved the same distance horizontally by actuator 44 (FIGS. 2 and 3).

In alternative embodiments, horizontal support 40 may be above angle bar 24 with the upper end of angle bar support 36 movably coupled to horizontal support 40 and the lower end of angle bar support 36 movably coupled to vertical support 38.

Figure 5:
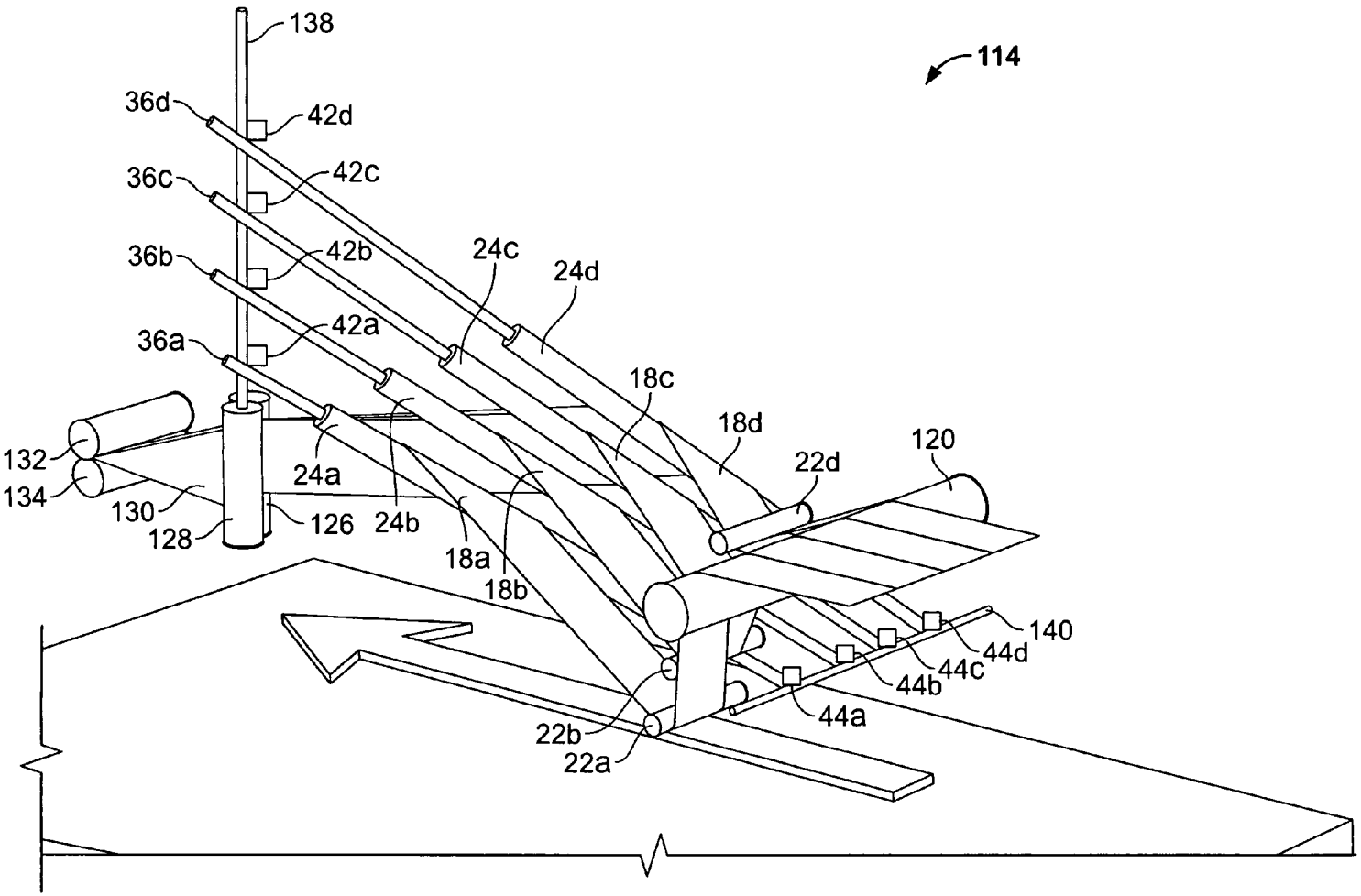
FIGS. 5 and 6 schematically show perspective views of a folder according to another embodiment of the present invention for merging multiple webs, or ribbons, into a ribbon bundle for longitudinal folding by a former.
Figure 6:
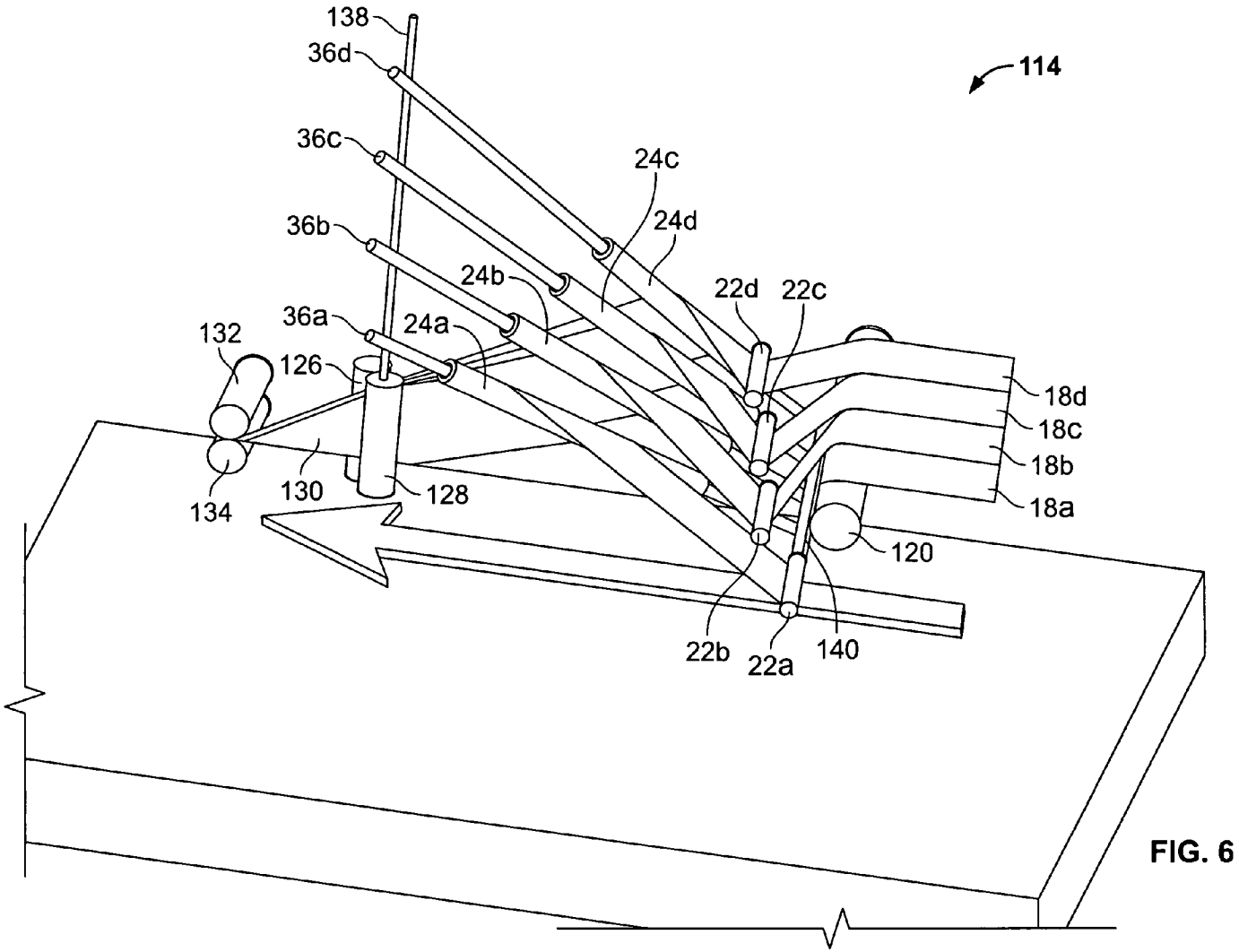

FIGS. 5 and 6 schematically show perspective views of a folder 114 for merging a plurality of webs or ribbons for example, four ribbons, ribbons 18*a*, 18*b*, 18*c*, 18*d*, into a ribbon bundle for longitudinal folding by a former 130. In a preferred embodiment, ribbons 18*a*, 18*b*, 18*c*, 18*d* are printed as a single web by an offset printing section 12 as shown in FIG. 1 and are formed by slitting single web 18 (FIG. 1) with a slitter. In alternative embodiments, webs 18*a*, 18*b*, 18*c*, 18*d* are printed by a plurality of printing sections and merged together to enter folder 114. The plurality of webs or ribbons may include any number of webs or ribbons desired. The webs or ribbons may be slit from a single web or merged together to enter folder from a plurality of printing sections or any desired combination thereof.

Ribbons 18*a*, 18*b*, 18*c*, 18*d*, parallel to the ground, pass over a pull roll 120 and then each ribbon 18*a*, 18*b*, 18*c*, 18*d* passes under a respective compensator roll 22*a*, 22*b*, 22*c*, 22*d*. Compensator rolls 22*a*, 22*b*, 22*c*, 22*d* may be radially offset from one another to space ribbons 18*a*, 18*b*, 18*c*, 18*d*. In a preferred embodiment, compensator rolls 22*a*, 22*b*, 22*c*, 22*d* are independently movable by respective actuators. Ribbons 18*a*, 18*b*, 18*c*, 18*d*, after passing under respective compensator rolls 22*a*, 22*b*, 22*c*, 22*d*, are reoriented by respective angle bars 24*a*, 24*b*, 24*c*, 24*d* from a horizontal orientation (traveling on a width of web 18) to a vertical orientation (traveling on one side of web 18). After ribbons 18*a*, 18*b*, 18*c*, 18*d* are vertically oriented, ribbons 18*a*, 18*b*, 18*c*, 18*d* are merged into a ribbon bundle by a pair of gather rolls 126, 128 or roll-top-of-former rolls. The ribbon bundle is then pulled over a former 130 by a pair of pull rolls 132, 134.

Each angle bar 24*a*, 24*b*, 24*c*, 24*d* is coupled to a respective angle bar support 36*a*, 36*b*, 36*c*, 36*d* which allows angle bars 24*a*, 24*b*, 24*c*, 24*d* each to be adjusted in two different dimensions. An upper end portion of each angle bar support 36*a*, 36*b*, 36*c*, 36*d* is movably coupled to a vertical support 138 and a lower end portion of each angle bar support 36*a*, 36*b*, 36*c*, 36*d* is movably coupled to a horizontal support 140. Each angle bar support 36*a*, 36*b*, 36*c*, 36*d* is coupled to a respective actuator 42*a*, 42*b*, 42*c*, 42*d* for moving angle bar supports 36*a*, 36*b*, 36*c*, 36*d* along vertical support 138. Each angle bar support 36*a*, 36*b*, 36*c*, 36*d* is also coupled to a respective actuator 44*a*, 44*b*, 44*c*, 44*d* for moving angle bar supports 36*a*, 36*b*, 36*c*, 36*d* along horizontal support 140. As a result, angle bar supports 36*a*, 36*b*, 36*c*, 36*d* are independently vertically movable along vertical support 138 and independently horizontally movable along horizontal support 140. Actuators 42*a*, 42*b*, 42*c*, 42*d*, 44*a*, 44*b*, 44*c*, 44*d* are omitted from FIG. 6 for clarity.

Figure 7:
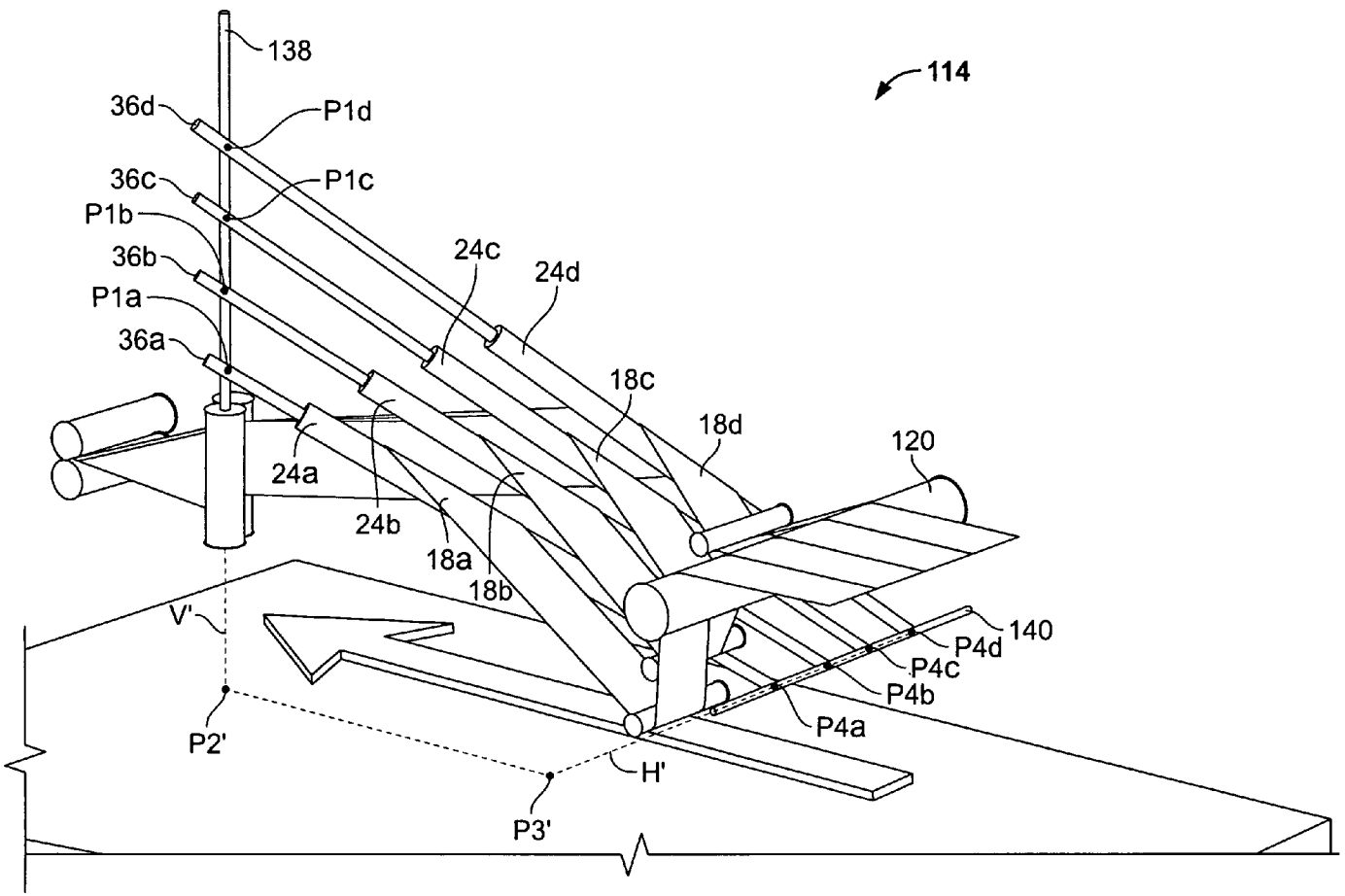
FIG. 7 schematically shows the spacing between certain components of the folder shown in FIGS. 5 and 6.

FIG. 7 shows the spacing between important points of folder 114. Actuators 42*a*, 42*b*, 42*c*, 42*d*, 44*a*, 44*b*, 44*c*, 44*d* are omitted from FIG. 7 for clarity. Points P1*a*, P1*b*, P1*c*, P1*d* illustrate positions of respective angle bar supports 36*a*, 36*b*, 36*c*, 36*d* along vertical support 138 and points P4*a*, P4*b*, P4*c*, P4*d* illustrate positions of respective angle bar supports 36*a*, 36*b*, 36*c*, 36*d* along horizontal support 140. Point P2' illustrates where a plane of horizontal support 140 that is perpendicular to an axis V' of vertical support 138 intersects axis V' and point P3' illustrates where a plane of vertical support 138 that is perpendicular to an axis H' of horizontal support 140 intersects axis H'. In a preferred embodiment, distances between point P1*a*, P1*b*, P1*c*, P1*d* and point P2' always equals respective distances between points P4*a*, P4*b*, P4*c*, P4*d* and point P3' and distance between point P2' and point P3' is greater than zero. As a result, if at least one of angle bar supports 36*a*, 36*b*, 36*c*, 36*d* is moved vertically along vertical support 138 by the respective actuator 42*a*, 42*b*, 42*c*, 42*d* (FIG. 5), the at least one of the angle bar support 36*a*, 36*b*, 36*c*, 36*d* is also moved the same distance horizontally along horizontal support 140 by the respective actuator 44*a*, 44*b*, 44*c*, 44*d* (FIG. 5). For example, if angle bar support 36*a* is moved vertically by actuator 42*a* (FIG. 5), angle bar support 36*a* is moved the same distance horizontally by actuator 44*a* (FIG. 5).

Figure 8:
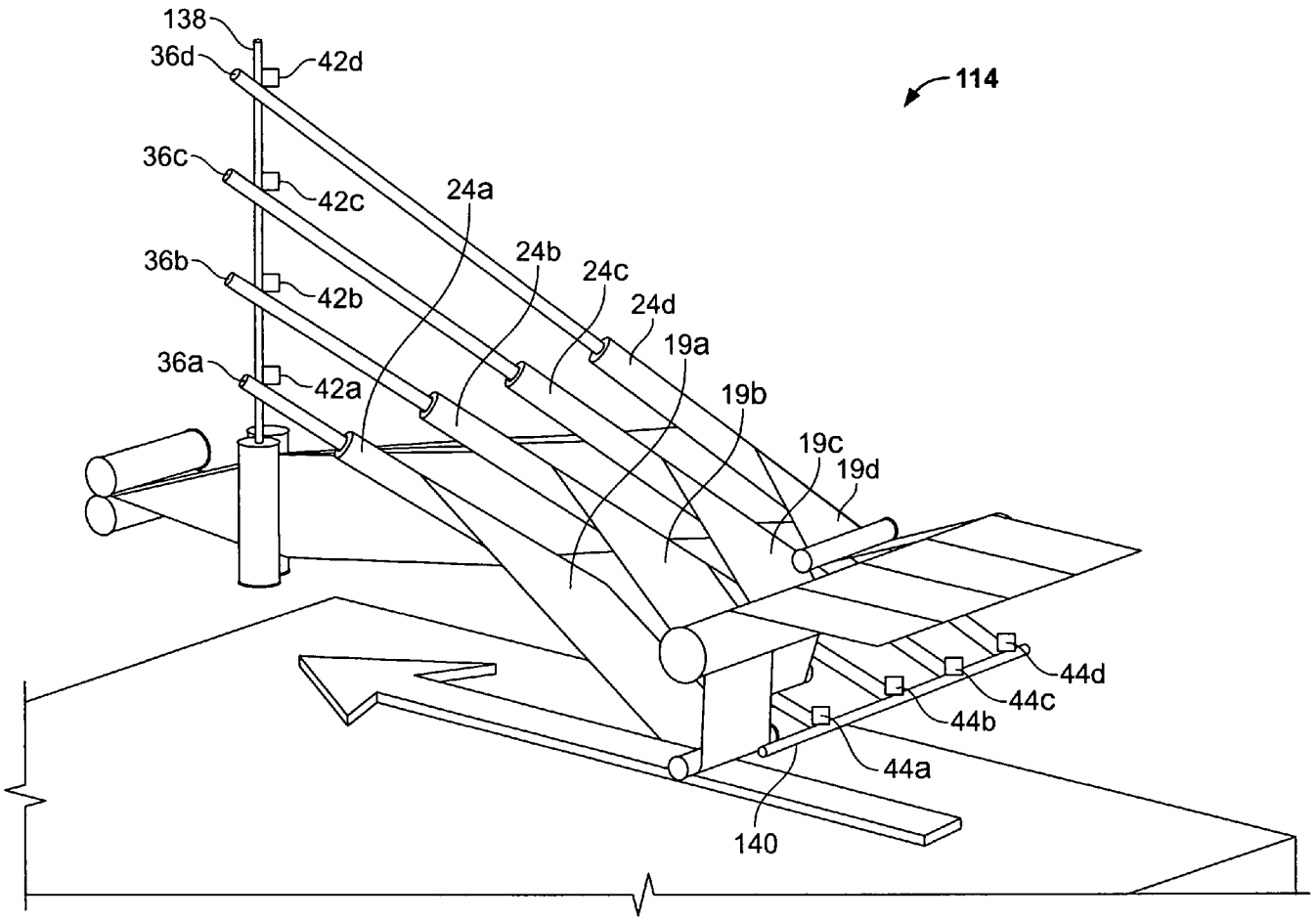
FIG. 8 schematically shows a perspective view of the folder shown in FIGS. 5 to 7 adjusted to transport wider ribbons.

FIG. 8 shows a perspective view of folder 114 adjusted to guide ribbons 19*a*, 19*b*, 19*c*, 19*d* that are wider than ribbons 18*a*, 18*b*, 18*c*, 18*d* shown in FIGS. 5 to 7 with angle bars 24*a*, 24*b*, 24*c*, 24*d*. In order to accommodate wider ribbons 19*a*, 19*b*, 19*c*, 19*d*, each angle bar support 36*a*, 36*b*, 36*c*, 36*d* is moved upward on vertical support 138 by the respective actuator 42*a*, 42*b*, 42*c*, 42*d* and each angle bar support 36*a*, 36*b*, 36*c*, 36*d* is moved sideways on horizontal support 140 by the respective actuator 44*a*, 44*b*, 44*c*, 44*d* the same distance that each angle bar support 36*a*, 36*b*, 36*c*, 36*d* is moved upward on vertical support 138.

Figure 9:
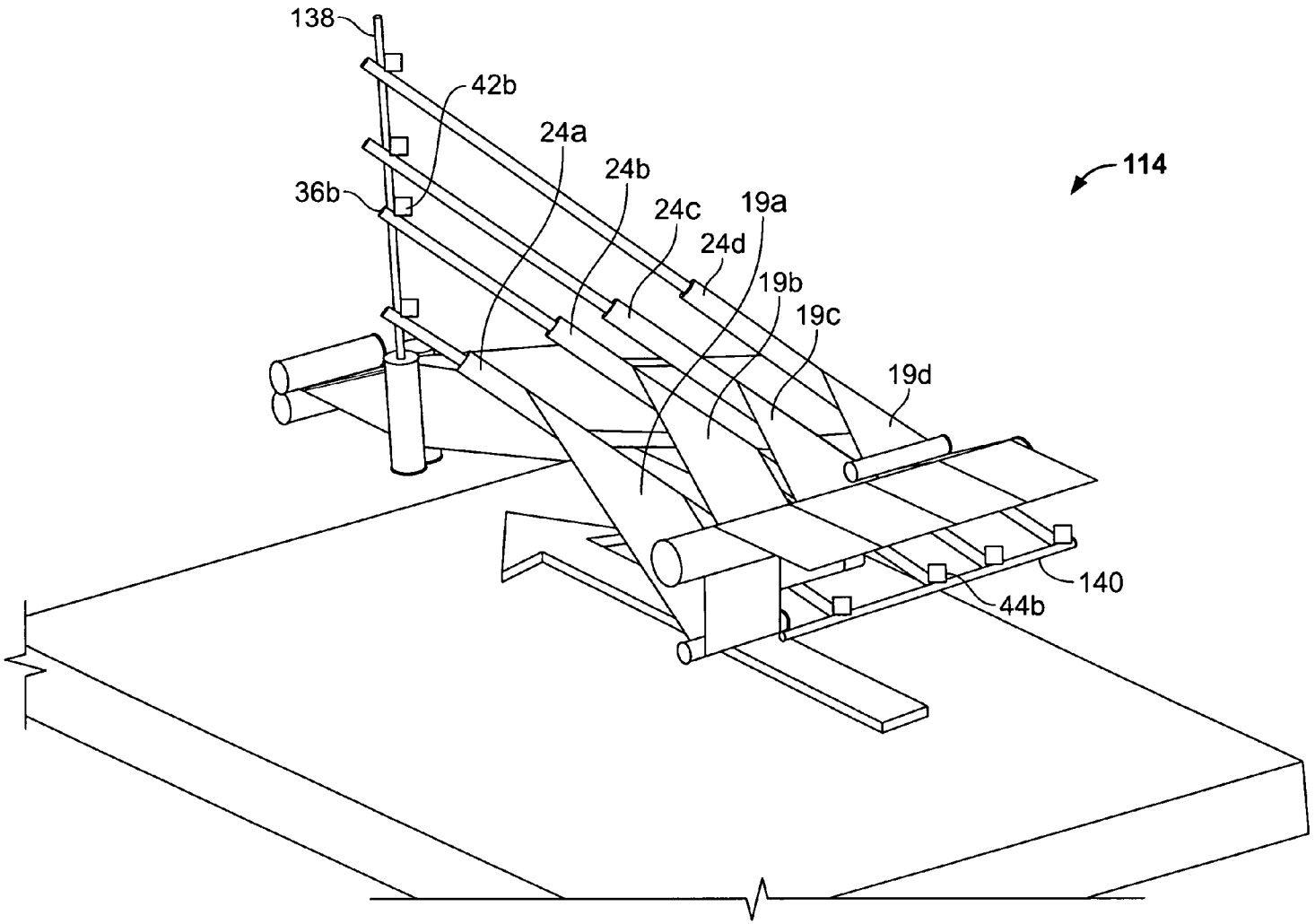
FIG. 9 schematically shows a perspective view of the folder shown in FIGS. 5 to 8 transporting ribbons, with the position of one angle bar adjusted.

FIG. 9 shows a perspective view of folder 114 transporting ribbons 19*a*, 19*b*, 19*c*, 19*d* as shown in FIG. 7, but with the position of angle bar 24*b* adjusted. Angle bars 24*a*, 24*c*, 24*d* remain in the same positions shown in FIG. 7. Angle bar 24*b* is moved away from angle bar 24*a* and towards angle bar 24*c* by moving angle bar support 36*b* upward on vertical support 138 by actuator 42*b* and moving angle bar support 36*b* sideways on horizontal support 140 by actuator 44*b* the same distance that angle bar support 36*b* is moved upward on vertical support 138. By adjusting the position of angle bar 24*b*, a position of web 19*b* with respect to the ribbons 19*a*, 19*c*, 19*d* may be adjusted.

Figure 10:
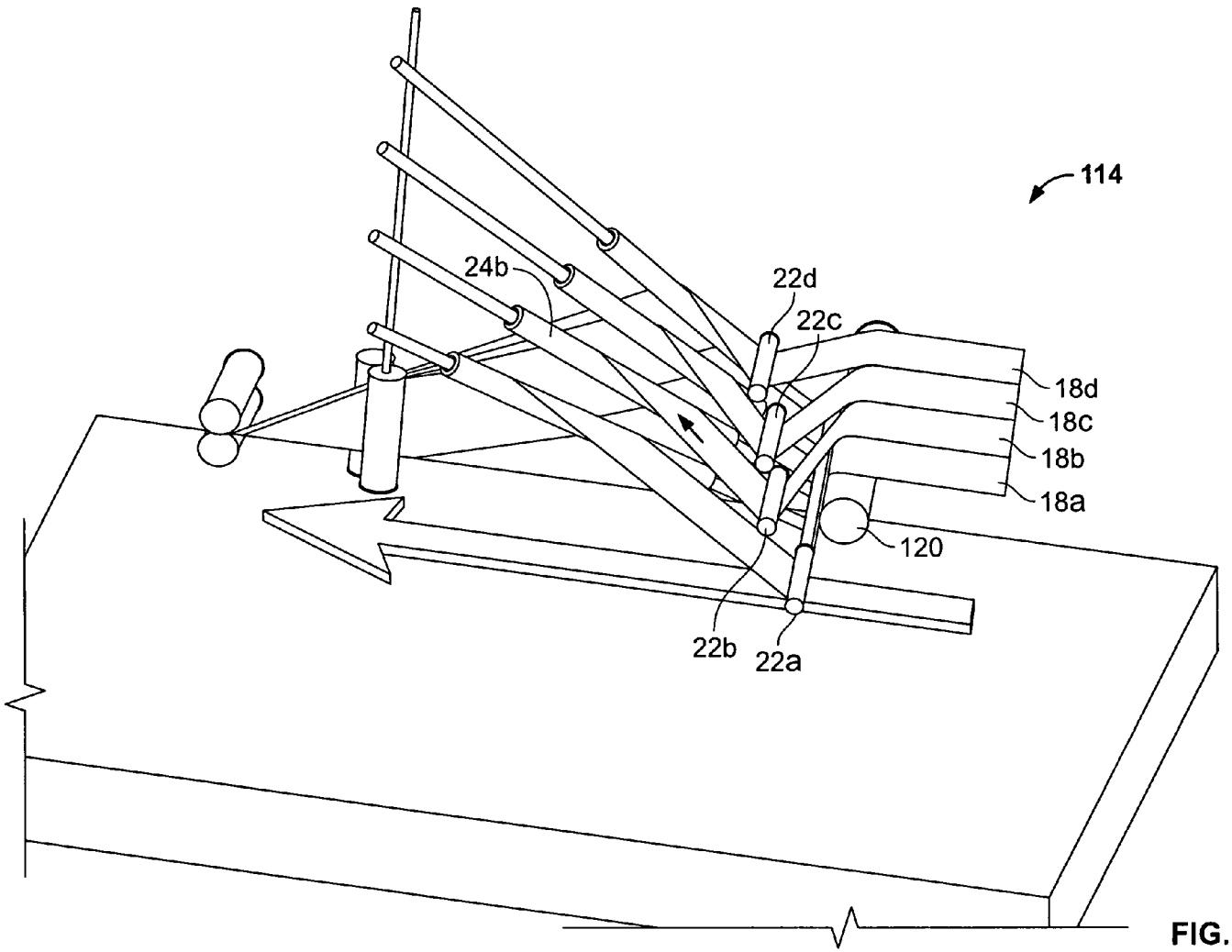
FIG. 10 schematically shows a perspective view of the shown in FIGS. 5 to 9, with a position of one compensator roll adjusted.

FIG. 10 shows a perspective view of folder 114 transporting ribbons 18*a*, 18*b*, 18*c*, 18*d* as shown in FIG. 6, but with the position of compensator roll 22*b* adjusted. With respect to FIG. 6, compensator roll 22*b* is moved radially away from pull roll 120 and towards angle bar 24*b* via an adjusting actuator. The positions of any of compensator rolls 22*a*, 22*b*, 22*c*, 22*d*, independently or together, may be adjusted to accommodate changes in cut-off registration or to correct registration errors. Actuators 42*a*, 42*b*, 42*c*, 42*d*, 44*a*, 44*b*, 44*c*, 44*d* are omitted from FIG. 10 for clarity.

The present invention described herein advantageously provides a web guiding apparatus that may control the distance of the web from the ground when the web exits the web guiding apparatus or folder, may accommodate changes in the side to side locations of the web's entry point in the folder and may control the timing and/or registration of the web. Advantageously, the present web guiding apparatus may minimize the size and complexity of previous angle and turner bar mechanisms, may minimize the web length required to make the changes and may reduce the quantity of turner bar, angle bars or rolls needed. Adjustments to the web guiding apparatus may also be less complex.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A web guiding apparatus comprising:

a first support;

a second support;

a first angle bar for guiding a first web movably coupled to the first support and the second support; and a second angle bar for guiding a second web movably coupled to the first support and the second support;

the first support being coincident with a vertical axis and the second support being coincident with a horizontal axis.

2. The web guiding apparatus recited in claim 1 further comprising:

a first angle bar support coupling an upper end of the first angle bar to the first support and a second end of the first angle bar to the second support; and a second angle bar support coupling an upper end of the second angle bar to the first support and a lower end of the second angle bar to the second support.

3. The web guiding apparatus recited in claim 1 further comprising at least one further angle bar coupled to the first support and the second support.

4. The web guiding apparatus recited in claim 1 further comprising a horizontally aligned first compensator roll upstream of the first angle bar for guiding the first web in a horizontal orientation to the first angle bar, the first angle bar configured to reorient the first web to a vertical orientation.

5. The web guiding apparatus recited in claim 4 further comprising a horizontally aligned second compensator roll upstream of the second angle bar for guiding the second web in a horizontal orientation to the second angle bar, the second angle bar configured to reorient the second web to a vertical orientation.

6. The web guiding apparatus recited in claim 5 further comprising a pair of vertically aligned gather rolls downstream of the first and second angle bars for merging the vertically oriented first and second webs.

7. The web guiding apparatus recited in claim 6 further comprising a horizontally aligned former downstream of the gather rolls for longitudinally folding the merged first and second webs.

8. A web guiding apparatus comprising:

a first support;

a second support;

a first angle bar for guiding a first web movably coupled to the first support and the second support;

a second angle bar for guiding a second web movably coupled to the first support and the second support;

a first actuator for moving the first angle bar with respect to the first support;

a second actuator for moving the first angle bar with respect to the second support;

a third actuator for moving the second angle bar with respect to the first support; and a fourth actuator for moving the second angle bar with respect to the second support.

9. The web guiding apparatus recited in claim 8 further comprising:

a first angle bar support coupling an upper end of the first angle bar to the first support and a second end of the first angle bar to the second support; and a second angle bar support coupling an upper end of the second angle bar to the first support and a lower end of the second angle bar to the second support.

10. The web guiding apparatus recited in claim 8 further comprising at least one further angle bar coupled to the first support and the second support.

11. The web guiding apparatus recited in claim 8 wherein the first support is coincident with a vertical axis and the second support is coincident with a horizontal axis.

12. The web guiding apparatus recited in claim 8 further comprising a horizontally aligned first compensator roll upstream of the first angle bar for guiding the first web in a horizontal orientation to the first angle bar, the first angle bar configured to reorient the first web to a vertical orientation.

13. The web guiding apparatus recited in claim 12 further comprising a horizontally aligned second compensator roll upstream of the second angle bar for guiding the second web in a horizontal orientation to the second angle bar, the second angle bar configured to reorient the second web to a vertical orientation.

14. The web guiding apparatus recited in claim 13 further comprising a pair of vertically aligned gather rolls downstream of the first and second angle bars for merging the vertically oriented first and second webs.

15. The web guiding apparatus recited in claim 14 further comprising a horizontally aligned former downstream of the gather rolls for longitudinally folding the merged first and second webs.

* * * * *